US011683877B2

(12) United States Patent
Barth et al.

(10) Patent No.: US 11,683,877 B2
(45) Date of Patent: Jun. 20, 2023

(54) COMMUNICATION ADAPTOR FOR CONVERTER FOR DRIVING LIGHTING MEANS

(71) Applicant: TRIDONIC GMBH & CO KG, Dornbirn (AT)

(72) Inventors: Alexander Barth, Alberschwende (AT); Frank Lochmann, Achberg (DE); Fabio Romano, Altach (AT)

(73) Assignee: Tridonic GmbH & Co KG, Dornbirn (AT)

( * ) Notice: Subject to any disclaimer, the term of this patent is extended or adjusted under 35 U.S.C. 154(b) by 127 days.

(21) Appl. No.: 17/291,395

(22) PCT Filed: Nov. 27, 2019

(86) PCT No.: PCT/EP2019/082816

§ 371 (c)(1),
(2) Date: May 5, 2021

(87) PCT Pub. No.: WO2020/109433

PCT Pub. Date: Jun. 4, 2020

(65) Prior Publication Data

US 2022/0007485 A1 Jan. 6, 2022

(30) Foreign Application Priority Data

Nov. 27, 2018 (EP) ..... 18208552

(51) Int. Cl.
*H05B 47/19* (2020.01)
*H05B 47/185* (2020.01)
*H05B 47/18* (2020.01)

(52) U.S. Cl.
CPC ..... *H05B 47/19* (2020.01); *H05B 47/18* (2020.01); *H05B 47/185* (2020.01)

(58) Field of Classification Search
CPC ..... H05B 47/18; H05B 47/19; H05B 47/185
See application file for complete search history.

(56) References Cited

U.S. PATENT DOCUMENTS

2014/0293276 A1 10/2014 Hughes et al.
2015/0296598 A1* 10/2015 Haid ..... H05B 45/50 315/291

(Continued)

FOREIGN PATENT DOCUMENTS

CN 203691677 U * 7/2014
CN 207 603 936 7/2018

(Continued)

OTHER PUBLICATIONS

Machine Translation of CN-203691677-U (Year: 2014).*

(Continued)

*Primary Examiner* — Raymond R Chai
(74) *Attorney, Agent, or Firm* — Andrus Intellectual Property Law, LLP

(57) ABSTRACT

The invention proposes a communication adaptor, comprising within one casing: a transmission antenna, a wired control interface connected to wired control interface terminals, a control circuitry for converting wirelessly received wireless communication signals into wired control interface signals and vice versa, wherein the adaptor is designed such that it can be brought in close contact with a reception antenna of a converter for lighting mean, such as e.g. LEDs, in order to establish a wireless communication, wherein the control circuitry and the wired control interface are powered by means of the wired control interface terminals.

12 Claims, 3 Drawing Sheets

(56) References Cited

U.S. PATENT DOCUMENTS

| | | | | |
|---|---|---|---|---|
| 2016/0165702 | A1* | 6/2016 | Lai | H05B 45/22 315/297 |
| 2016/0327255 | A1 | 11/2016 | Wittmann | |
| 2017/0231069 | A1* | 8/2017 | Winslett | H05B 45/31 |
| 2018/0035518 | A1* | 2/2018 | Cook | H04L 12/2816 |
| 2018/0042089 | A1* | 2/2018 | Cho | H05B 47/18 |
| 2018/0092186 | A1* | 3/2018 | Stuby, Jr. | G01J 1/44 |
| 2018/0302158 | A1* | 10/2018 | Norval | F21V 33/00 |
| 2019/0297710 | A1* | 9/2019 | Crenshaw | H02J 9/065 |
| 2020/0163179 | A1* | 5/2020 | Ou | H05B 47/19 |
| 2021/0226828 | A1* | 7/2021 | Wilhelmsson | H04L 27/04 |

FOREIGN PATENT DOCUMENTS

| | | | | |
|---|---|---|---|---|
| JP | 2018037232 | A * | 3/2018 | |
| WO | WO-2015089168 | A1 * | 6/2015 | F21K 9/23 |
| WO | 2016110833 | | 7/2016 | |
| WO | 22018036771 | | 3/2018 | |

OTHER PUBLICATIONS

Shunli et al. "A wideband and low power dual-band ASK transceiverfor intro/inter-chip communication", 2015 IEEE MTT-S International Microwave Symposium IEEE, May 17, 2015 (abstract only).

International Search Report dated Feb. 4, 2020 in priority PCT application PCT/EP2019/082816.

Shunli et al. "A wideband and low power dual-band ASK transceiverfor intro/inter-chip communication", 2015 IEEE MTT-S International Microwave Symposium IEEE, May 17, 2015.

Helvar LL1x2130-SR, Strain Relief Installation Guide, undated, 1 page.

"Strain-relief set 43x30mm", LED Drivers Accessories, Tridonic, Article Information Jan. 2023, www.tridonic.com, 2 pages.

* cited by examiner

COMMUNICATION ADAPTOR FOR CONVERTER FOR DRIVING LIGHTING MEANS

CROSS REFERENCE TO RELATED APPLICATIONS

The present application is the U.S. national stage application of international application PCT/EP2019/082816 filed Nov. 27, 2019, which international application was published on Jun. 4, 2020 as International Publication WO 2020/109433 A1. The international application claims priority to European Patent Application 18208552.2 filed Nov. 27, 2018.

FIELD OF THE INVENTION

The present invention is in the area of providing external communication for converter for driving lighting means, such as for example LED converter

BACKGROUND OF THE INVENTION

It is well known that such converter may be provided with means for wireless or wired communication. An example of a wired communication is the provision of wired control interface terminals, e.g. for connecting a wired control interface according to the DALI standard protocol.

An example for wireless communication is near field communication (NFC), in which case the converter is provided with a reception antenna exposed to the outside of the casing of the converter. Such converter will be called in the following "wireless communication enabled converter".

According to the prior art there is the problem that, obviously, a converter could technically be provided with all wireless and wired communication means available. However, this would lead to increased costs and sizes of the converters. The cost aspect and the size aspect are more important, as in the practical use of the converter, obviously, not all communication capabilities will actually be exploited in use.

SUMMARY OF THE INVENTION

Therefore, it is the object of the present invention to propose a modular communication approach for a wireless communication enabled converter.

This object is solved according to the present invention by means of the independent claims. The dependent claims further develop the central idea of the invention.

According to a first aspect of the invention, a communication adaptor is provided. The communication adaptor has a casing or housing, in which there are provided at least a transmission antenna, a wired control interface connected to wired control interface terminals of the communication adaptor, and a control circuitry for converting wireless received wireless communication, preferably radio frequency communication, signals into wired control interface signals and vice versa (backwards; from wired control interface signals into wireless communication signals).

The invention relates to a communication adaptor, comprising within a casing, an transmission antenna for wireless communication, preferably radio frequency communication, more preferably a near field communication NFC antenna, a wired control interface connected to wired control interface terminals, preferably a DALI interface, the wired control interface terminals forming a part of the communication adaptor, a control circuitry for converting wireless signals received at the transmission antenna for wireless communication into wired control interface signals to be supplied to the wired control interface terminals and optionally vice versa, wherein the adaptor is designed such that it can be brought in close contact with a reception antenna for wireless communication of a converter for lighting means, such as e.g. LEDs, in order to establish a wireless communication, wherein the control circuitry and the wired control interface are powered by means of a DC voltage at the wired control interface terminals.

Other standards than the DALI standard protocol can be used, however, the use of a DALI protocol is preferred and stands as one example for a wired control interface protocol in which the wired control interface has a non-zero voltage in the quiescent state, such that the wired control interface voltage can be used as a low power supply by other wired control interface participants.

The adaptor according to the invention is designed such that it can be brought in close contact with a reception antenna of a converter for lighting means, such as for example LEDs. "Close contact" has to be understood in the sense that a wireless communication between the transmission antenna of the communication adaptor and the reception antenna of the converter can be established. Preferably, the control circuitry and the wired control interface of the communication adaptor are powered by means of the wired control interface terminals. In this case, the communication adaptor is preferably void of a dedicated power supply, but is preferably powered from the wired control interface terminals.

The casing of the adaptor may be provided with means for mechanically fixing the communication adaptor to a casing of a converter for lighting means. This fixing is preferably arranged such that the combined adaptor/converter kit does not have a maximum height going beyond the maximum height of the converter alone. This can be achieved for example by fixing the communication adaptor in the longitudinal axis of the converter casing, and preferably not "stacked on" the casing of the adaptor.

The adaptor may be designed to be mechanically engaged with engagement means of the converter, which engagement means of the converter are designed for mechanically attaching a strain relief module to the converter. Thus, these engagement means of the converter are efficiently used for two different purposes, i.e. a strain relief module (strain relief of the power supply wiring for the converter) or a communication adaptor module according to the present invention, which may in addition to the communication also provide for a strain relief for looped-through power supply wiring.

The casing of the adaptor may be provided with means for a snap-on connection to a casing of a converter for lighting means.

The wired control interface of the communication adaptor may comprise switching means for selectively short-circuiting the wired control interface terminals in order to send out data onto a connected wired control interface. Thus digital encoding may be achieved by selectively (and internally) short-circuiting the wired control interface terminals.

The circuitry may be designed to convert received wired control interface signal blocks into wireless communication high frequency (HF) bursts having a substantial time duration of a wired control interface block. Thus, preferably, the physical states "low" or "high" according to the wired control interface standard are converted in the presence (low) or absence (high) of wireless communication high frequency (HF) bursts.

The control circuitry of the communication adaptor may be designed to convert received wireless communication high frequency (HF) bursts into a short-circuiting of the wired control interface terminals, wherein the short-circuiting preferably has substantially the time duration of the received wireless communication bursts. In other words, the physical state "low" of a wired control interface corresponds to the presence of received wireless high frequency (HF) bursts, while the absence of wireless communication high frequency (HF) bursts (no receipt of wireless communication high frequency (HF) bursts) is converted into a wired control interface physical high signal.

The casing of the communication adaptor according to the present invention may be made of plastic material. Optionally it may be made at partially made from a metal. The transmission antenna is arranged such that it is not shielded by such casing. In case that the casing of the communication adaptor is made from a metal, the transmission antenna may be placed outside the casing or there might be an opening in the casing close to the transmission antenna.

The communication adaptor may furthermore be provided with input terminals and output terminals and designed for looping through a mains power supply received at the input terminals to the output terminals, in order to provide a power supply for a converter for lighting means.

A further aspect of the invention relates to a kit comprising a wireless communication enabled converter for lighting means and a communication adaptor according to the above-captioned design.

The casing of the converter for lighting means may be provided with engagement means designed for mechanically attaching a strain relief module onto the converter. Preferably, the converter is void of wired control interface terminals such that its wired control interface enablement is only achieved when the converter is in wireless communication with a communication adaptor according to the present invention.

The casing of the converter for lighting means may be provided with engagement means designed for mechanically attaching a strain relief module onto the converter. Preferably, the converter is void of wired control interface terminals such that its wired control interface enablement is only achieved when the converter is in wireless communication with a communication adaptor according to the present invention.

A yet further aspect of the invention relates to method for converting wired control interface signals to wireless communication signals, wherein received wired control interface signals are converted into wireless communication high frequency (HF) bursts having substantially the time duration of the wired control interface signal blocks.

Yet a further aspect of the invention relates to a method for converting wireless communication signals into wired control interface signals, wherein received wireless communication high frequency (HF) burst are converted into a short circuiting of wired control interface terminals of a wired control interface, wherein the short circuiting substantially has the same time duration as the received wireless communication bursts. Thereby, the physical state "low" of the wired control interface signal is preferably encoded by the presence of a wireless communication high frequency (HF) burst.

Yet another aspect of the invention is the extension of a wireless communication enabled converter designed to be programmed by a wireless communication interface to be enhanced by the communication adaptor to a dimmable and fully controllable converter for lighting means.

Further aspects, advantages and objects of the invention will become evident for the skilled reader by means of the following detailed description of the embodiments of the invention, when taking into conjunction with the figures of the enclosed drawings.

DETAILED DESCRIPTION

Figure 1:
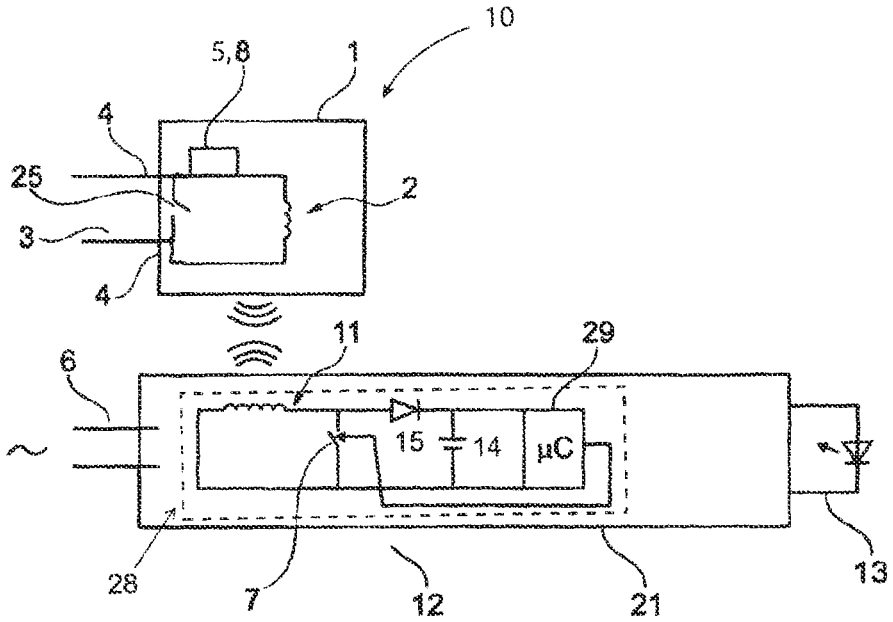
FIG. 1 shows schematically the circuitry of a wireless communication enabled converter for lighting means and a communication adaptor according to the present invention.

FIG. 1 shows schematically a converter 12 enabled for wireless communication, preferably radio frequency communication, e.g. a near field communication (NFC) enabled converter 12, according to the present invention. The converter 12 is provided with mains input terminals 6. As schematically shown, the converter 12 is designed for driving lighting means 13, such that as for example a LED load.

The circuitry of a LED driver/converter 12 required for driving the lighting means (e.g. LED) 13 is well known to the skilled person and is not illustrated in FIG. 1. The circuitry of a LED driver/converter 12 required for driving the lighting means (LED) 13 may comprise for instance a power factor correction circuit (PFC) followed by a switched converter designed to control the current through the lighting means (LED) 13.

On the other hand, FIG. 1 shows a wireless communication reception unit 28 comprising a microcontroller 29 which is functionally connected with a reception antenna 11 for wireless communication, e.g. near field communication (NFC). The microcontroller 29 is designed to monitor and evaluate whether and which signals are received by the reception antenna 11. For instance, the microcontroller 29 may be designed to monitor and evaluate the voltage induced into the reception antenna. The wireless communication reception unit 28 may be for instance be similar to a typical architecture of conventional passive near field communication (NFC) tag interface. The reception antenna 11 may comprise of one or many loops of conductive wires, which are designed to receive energy and modulated information carried by an oscillating magnetic field applied from wireless communication sending unit as it may be formed by a near field communication (NFC) programmer or the wireless communication transmission antenna 2 of the communication adaptor 10. The reception antenna 11 may be connected to a reception match circuit (not shown here) which transforms the impedance of reception antenna 11 to a suitable value. The diode 15 and capacitor 14 form a demodulator circuit which demodulates the received signal and recovers the original information. Further, there is a switch 7 which may form a load modulator designed to modulate the impedance of the load connecting to the reception antenna 11 to transmit information.

Further the may be a rectifier and regulator circuit (not shown here) which is connected to the reception antenna 11 and is designed to convert the received radio frequency energy to regulated direct current energy that could be used for powering system components as for example the microcontroller 29.

Furthermore, the wireless communication enabled converter 12 according to the present invention has the characteristics that the microcontroller 29 can control the emitting high frequency (HF) operation of the reception antenna 11 in a burst mode, as schematically shown by means of a control path to a switch 7.

The wireless communication enabled converter 12 with the microcontroller 29 and the reception antenna 11 may be designed to be programmed or to be configured by the wireless communication reception unit 28. For instance the wireless communication enabled converter 12 can be designed that the nominal current through the lighting means 13 may be programmed via the wireless communication reception unit 28.

According to the invention also a communication adaptor 10 is shown, which has terminals 4 for connecting for example a wired control interface 3, e.g. DALI or any other bus which has a non-voltage level in the quiescent state of the bus protocol.

The communication adaptor 10 comprises a wireless communication transmission unit 5 which may be similar to a typical architecture of near field communication (NFC) reader interface. Wireless communication transmission antenna 2 may comprise one or many loops of conductive wires, which may be designed to generate an oscillating magnetic field and thereby may be designed to transmit and receive wireless communication signals. There may be a transmission antenna match circuit (not shown) designed to transform the impedance of wireless communication transmission antenna 2 to a suitable value for improving efficiency. Modulator 8 may be designed to modulate the signal used for generating oscillating magnetic field according to the data received from the wired control interface and which are to be transmitted. There may be an antenna driver (not shown) which amplifies the signal generated by modulator 8, and drives wireless communication transmission antenna 2 via transmission antenna match circuit. To improve power efficiency, antenna driver may have a low output impedance. A transmission demodulator (not shown) may measure and track the strength of the current flowing through wireless communication transmission antenna 2, and demodulate the superimposed signal. There may be a control unit managing the operation of the communication adaptor 10. The wireless communication may use a carrier frequency of 13.56 MHz.

Thus, the communication adaptor 10 according to the present invention is preferably powered only by the wired control interface terminals 4, and is preferably void of any other power supply. The communication adaptor 10 as schematically illustrated has its own wireless communication transmission antenna 2 and a modulator 8. Upon receipt of wireless communication bursts by an electromagnetic wireless communication from between the antenna 11 of the converter 12 and the transmission antenna 2 of the communication adaptor 10, the modulator 8 receives such wireless communication signals and is designed to selectively short-circuit the wired control interface terminals 4, using a switch 25. In more detail, preferably the bus terminals 4 of the wired control interface 3 are short-circuited during the time period during which a wireless communication burst is received by the communication adaptor 10. In other words, the detection of a received wireless communication high frequency (HF) burst is translated, by the modulator 8 of the communication adaptor 10 into a corresponding time duration of a short-circuiting of the wired control interface 3.

On the other hand, when the communication adaptor 10 receives wired control interface signals, the modulator 8 is designed to modulate the emission mode of the transmission antenna 2 of the connection adaptor 10. Again, during the quiescent or high level state of the wired control interface 3, the modulator 8 will not cause any high frequency (HF) burst mode activity of the transmission antenna of the communication adaptor. On the other hand, during the time periods in which the communication adaptor 10 receives, at its wired control interface terminals 4, a physical wired control interface low state, the modulator 8 controls the emission mode of the transmission antenna 2 of the communication adaptor 10 to the emission of a high frequency (HF) burst.

Thereby the communication adaptor 10 may transfer the wired control interface signals via the transmission antenna 2 to the wireless communication reception unit 28 of the converter 12. This invention enables an extension of a wireless communication enabled converter 12 designed to be programmed by a wireless communication interface to be enhanced by the communication adaptor 10 to a dimmable and fully controllable converter for lighting means.

The converter 12 may change its operation depending of the signals received by the wired control interface 3 and transmitted by the communication adaptor 10. For instance the switched converter designed may control the current through the lighting means (LED) 13 depending on the signals of the wired control interface 3.

Figure 2:
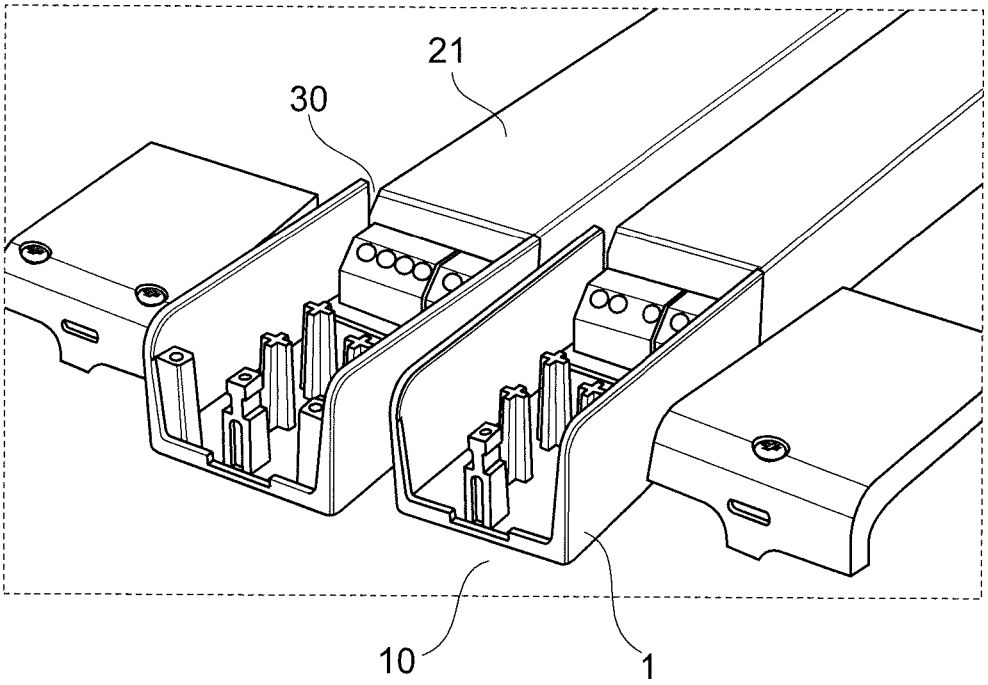
FIG. 2 shows the mechanical arrangement, especially the housing of a communication adaptor according to the present invention, wherein the communication adaptor is connected at engagement means of the converter which are designed for alternatively connect a strain relief module.

FIG. 2 shows schematically the casing/housing of a converter 12 for lighting means, which is known as such. The converter 12 for lighting means is provided with connection terminals for the power supply (mains connection) of the converter 12. Furthermore, the converter 12 is known, in a manner known as such, with engagement means in order to connect a strain relief module having a strain relief function as to power supply wiring for the converter 12.

As shown in FIG. 2, the casing 1 of the communication adaptor 10 according to the present invention can be attached (instead or as part of a strain relief module) onto the engagement means of the converter 12 (designed for attaching a strain relief module). This advantageously only leads to a longitudinal increase of the size of the converter 12, but does not increase the maximum height of the converter housing 21. The casing 1 of the communication adaptor 10 may further comprise cable holding means in order to provide a strain relief function.

Figure 3:
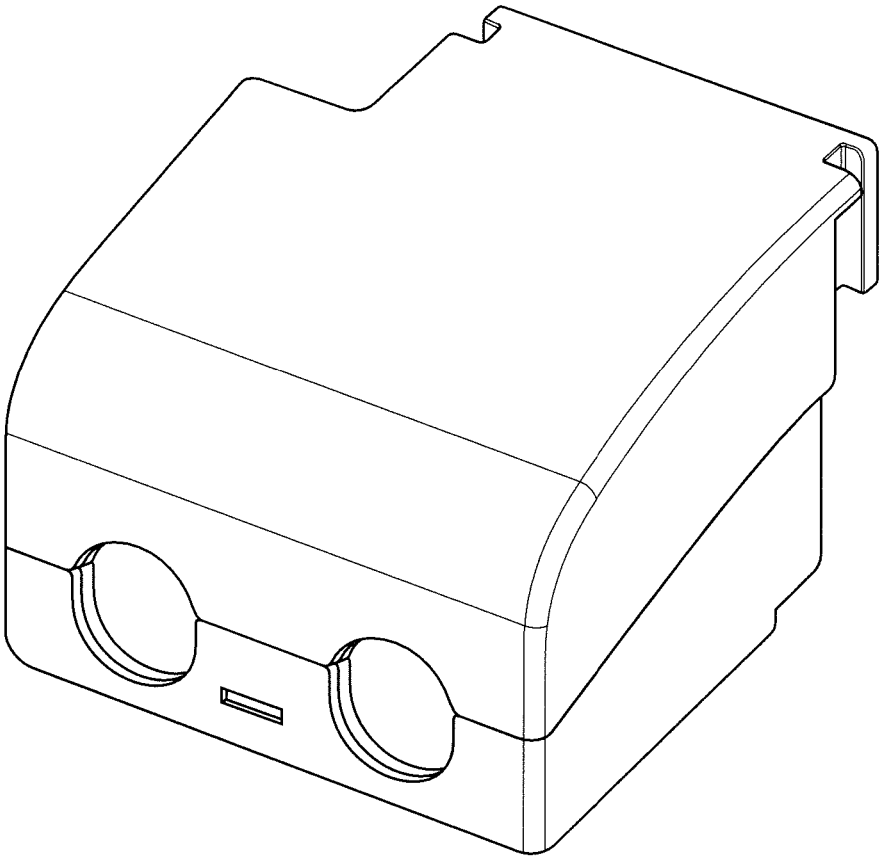
FIG. 3 shows the casing of a communication adaptor according to the present invention, having a snap-on connection for engagement with a casing of a converter in a manner such that the maximum height of the converter is not increased when attaching the communication adaptor according to the present invention.

FIG. 3 shows another example of the casing 1 of a communication adaptor 10 according to the present invention. The casing 1 is having a snap-on (or also snap-fit) connection for engagement with a casing of a converter 12 (not shown here) in a manner such that the maximum height of the converter 12 is not increased when attaching the communication adaptor 10 according to the present invention.

The communication adaptor according to the present invention does not necessarily need its own power supply or its own connection to a mains voltage supply. However, it may advantageously incorporate the function of a strain relief, such that the communication adaptor according to the invention may be called a strain relief module, having the dimension of known strain relief modules, however, with integrated wireless/wired control interface (e.g. NFC/DALI) adaptation functionality.

LIST OF REFERENCE SIGNS

1 Casing of the communication adaptor 10
2 wireless transmission antenna of the communication adaptor 10
3 Wired control interface, e.g. DALI
4 Wired control interface terminals
5 Control circuitry
6 Mains supply terminals of the converter 12
7 Switch
8 Modulator
10 Communication adaptor
11 reception antenna for wireless communication, e.g. NFC
12 Converter
13 Lighting means, e.g. LED
14 capacitor
15 diode
20 Mechanical fixing/connection means
21 Casing of the converter
25 Switching means of the wired control interface 3
28 Wireless communication reception unit
29 Microcontroller
30 Engagement means

What is claimed is:

1. A communication adaptor, comprising within a casing (1):

an adaptor antenna (2) for wireless communication;

a wired control interface (3) connected to wired control interface terminals (4);

the wired control interface terminals (4) forming a part of the communication adaptor;

a control circuitry (5) for converting wireless signals received at the adaptor antenna (2) for wireless communication into wired control interface signals to be supplied to the wired control interface terminals (4);

wherein the adaptor (10) is designed such that it can be brought in close contact with a converter antenna (11) for wireless communication of a converter (12) for lighting means (13) in order to establish a wireless communication;

wherein the control circuitry (5) and the wired control interface (3) are powered by means of a DC voltage at the wired control interface terminals (4); and wherein the adaptor (10) is designed to be mechanically engaged with engagement means (30) of the converter (12) designed for mechanically attaching a strain relief module to the converter (12).

2. The communication adaptor according to claim 1, wherein the casing (1) of the adaptor (10) is provided with means (20) for mechanically fixing the communication adaptor (1) to a casing (21) of a converter (12) for lighting means, such that the maximum height of the casing (21) of the converter (12) is not increased.

3. The communication adaptor according to claim 1, wherein the casing (1) of the adaptor (12) is provided with means for a snap-on connection to a casing of a converter for lighting means.

4. The communication adaptor according to claim 1, wherein the wired control interface (3) comprises switching means (25) for selectively short-circuiting the wired control interface terminals in order to send data onto a connected wired control interface.

5. The communication adaptor according to claim 1 wherein the control circuitry is designed to convert received wired control interface signal blocks into near field communication bursts having a time duration of a wired control interface signal block.

6. The communication adaptor according to claim 1 wherein the control circuitry is designed to convert received near field wireless communication bursts into a short circuiting of the wired control interface terminals, the short circuiting having a time duration of the received near field wireless communication bursts.

7. The communication adaptor according to claim 1, wherein the casing (1) of the adaptor (10) is at least partially made from metal and the converter antenna (2) is arranged such that it is not shielded by the casing.

8. The communication adaptor according to claim 1, further comprising input and output terminals for a looping through of a mains power supply to a converter for lighting means.

9. A kit comprising a wireless communication enabled converter for lighting means and a communication adaptor according to claim 1.

10. The communication adaptor according to claim 1, wherein the wired control interface is a DALI interface.

11. The communication adaptor according to claim 1, wherein the adaptor antenna is a near field communication antenna.

12. The communication adaptor according to claim 1, wherein the control circuitry (5) also converts wired control interface signals into wireless signals.

* * * * *